US007669741B2

(12) United States Patent
Ozaki

(10) Patent No.: US 7,669,741 B2
(45) Date of Patent: Mar. 2, 2010

(54) METHOD OF MANUFACTURING PLEATED PRODUCT AND FABRIC FOR PLEATED PRODUCT USED FOR THE METHOD

(75) Inventor: Yoshiyuki Ozaki, Fukuoka (JP)

(73) Assignee: Ozaki Pleats Co., Ltd., Fukuoka (JP)

( * ) Notice: Subject to any disclaimer, the term of this patent is extended or adjusted under 35 U.S.C. 154(b) by 1113 days.

(21) Appl. No.: 10/552,580

(22) PCT Filed: Apr. 7, 2004

(86) PCT No.: PCT/JP2004/005019

§ 371 (c)(1),
(2), (4) Date: Oct. 12, 2005

(87) PCT Pub. No.: WO2004/097102

PCT Pub. Date: Nov. 11, 2004

(65) Prior Publication Data

US 2006/0216463 A1 Sep. 28, 2006

(30) Foreign Application Priority Data

Apr. 25, 2003 (JP) ..... 2003-122096
Jul. 9, 2003 (JP) ..... 2003-272584

(51) Int. Cl.
*D05B 35/08* (2006.01)

(52) U.S. Cl. ..... 223/28

(58) Field of Classification Search ..... 223/28, 223/29, 37

See application file for complete search history.

(56) References Cited

U.S. PATENT DOCUMENTS 3,823,452 A * 7/1974 Harrow ..... 28/164

(Continued)

FOREIGN PATENT DOCUMENTS

JP 46-42356 12/1971

(Continued)

*Primary Examiner*—Shaun R Hurley
*Assistant Examiner*—Andrew W Sutton
(74) *Attorney, Agent, or Firm*—Wenderoth, Lind & Ponack, L.L.P.

(57) ABSTRACT

A method of manufacturing a pleated product capable of partially pleating a fabric so that boundaries between pleat portions and non-pleat portions can be conspicuous and a fabric for the pleated product used for the method. In this method, a part of the fabric for the pleated product in which one of warp and weft is formed of easy-to-pleat yarn and the other formed of hard-to-pleat yarn is folded along a folding line tilted relative to the warp and the weft, the fabric is pleated up to the folding line in the passing direction of the warp or the weft, and the fabric is unfolded and washed. Effective pleats are formed only in the passing direction of the easy-to-pleat yarn on a plane on one side of the folded portion and not formed in the passing direction of the hard-to-pleat yarn on a plane on the other side of the folded portion. The pleats in the passing direction of the hard-to-pleat yarn are eliminated by a washing step to form a non-pleat portion, and the pleats formed on the passing direction of the easy-to-pleat yarn form a pleat portion in which the pleat lines are firmly shaped up to the folding line.

16 Claims, 9 Drawing Sheets

U.S. PATENT DOCUMENTS

| | | | | | |
|---|---|---|---|---|---|
| 4,623,770 | A | * | 11/1986 | Kojima | 219/768 |
| 4,725,486 | A | * | 2/1988 | Corbiere | 428/152 |
| 5,027,988 | A | * | 7/1991 | Corbiere | 223/28 |
| 6,099,962 | A | * | 8/2000 | Sato et al. | 428/377 |

FOREIGN PATENT DOCUMENTS

| | | |
|---|---|---|
| JP | 61-258003 | 11/1986 |
| JP | 5-93364 | 4/1993 |
| JP | 2000-192352 | 7/2000 |
| JP | 2000-290856 | 10/2000 |
| JP | 2002-212875 | 7/2002 |
| JP | 2004-124348 | 4/2004 |

* cited by examiner

METHOD OF MANUFACTURING PLEATED PRODUCT AND FABRIC FOR PLEATED PRODUCT USED FOR THE METHOD

TECHNICAL FIELD

The present invention relates to a method of manufacturing a pleated product comprising a partially pleated fabric and a fabric for a pleated product used for the method.

BACKGROUND ART

Pleating has been widely known as a process for forming wimples on a fabric. The pleating is applied to garments such as blouses, dresses or skirts to give the garments a nice shading effect. In addition, the flexibility of the pleated garments has the advantage that the wearer has no feeling of uncomfortable tightness even if he or she wears closely fitting clothes.

To manufacture a garment with pleating, a flat material is first pleated and then cut into a predetermined shape and size, or a material already cut into a predetermined shape and size is pleated, followed by sewing. As another method, a material can be pleated not prior to sewing but after sewing as described in Unexamined Japanese Patent Publication No. Hei 5-93364 (referred to as "Patent Document No. 1" hereinafter), on page 2, right-hand column and in FIG. 2.

Patent Document No. 1 further discloses a partial pleating method in which a T-shirt pleated on its left part is removed from a pleating machine by reversing the machine and then again processed by the machine with its right part ahead. In addition, the document describes the use of a pleating pattern having a flat surface in the center thereof which is capable of partial pleating without reversing a pleating machine.

DISCLOSURE OF THE INVENTION

In the method in which the pleating machine is reversed or the method using the pleating pattern with the flat surface in the center, however, it is difficult to process a material so that boundaries between pleat portions and non-pleat portions are conspicuous. Such a process has been hitherto regarded as impossible because boundaries between pleat portions and non-pleat portions are defined by the conditions as to how a fabric is pressed by edges of pleating patterns.

In view of this, an object of the present invention is to provide a method of manufacturing a pleated product which is capable of partially pleating a fabric so that boundaries between pleat portions and non-pleat portions are conspicuous and to provide a fabric for a pleated product used for the method.

In order to solve the above problem, a method of manufacturing a pleated product according to the present invention comprises: folding a part of a fabric for a pleated product comprising warp and weft along a folding line tilted, preferably at 45 degrees, relative to the warp and the weft, one of the warp and the weft being formed of easy-to-pleat yarn and the other formed of hard-to-pleat yarn; pleating the fabric up to the folding line in a passing direction of the warp or the weft; and unfolding and washing the fabric.

In the method of manufacturing a pleated product of the present invention, since a part of a fabric for a pleated product in which one of the warp and the weft is formed of easy-to-pleat yarn and the other formed of hard-to-pleat yarn is folded along a folding line tilted at 45 degrees relative to the warp and the weft, a passing direction of the easy-to-pleat yarn on a plane on one side of the folded portion corresponds to a passing direction of the hard-to-pleat yarn on a plane on the other side of the folded portion. In other words, in the folded portion of the fabric for a pleated product, the passing direction of the easy-to-pleat yarn corresponds to a direction of forming pleat lines on one plane of the fabric while the passing direction of the hard-to-pleat yarn corresponds to a direction of forming pleat lines on the other plane of the fabric.

Thus, when the fabric is kept folded and pleated up to the folding line in a passing direction of the warp or the weft, effective pleats are formed only in the passing direction of easy-to-pleat yarn on a plane on one side of the folded portion and not formed in the passing direction of hard-to-pleat yarn on a plane on the other side of the folded portion. The pleats in the passing direction of the hard-to-pleat yarn are eliminated by a following washing step to form a non-pleat portion, and the pleats formed in the passing direction of the easy-to-pleat yarn form a pleat portion in which the pleat lines are firmly shaped up to the folding line. In this manner, the pleated product having conspicuous boundaries between the pleat portion and the non-pleat portion can be obtained.

Here, a part of the fabric for a pleated product can be folded more than once along folding lines tilted at 45 degrees relative to the warp and the weft and then pleated. Then, in the portion folded more than once, an additional area in which the passing direction of the easy-to-pleat yarn corresponds to the direction of forming pleat lines can be formed, and an additional area in which the hard-to-pleat yarn corresponds to the direction of forming pleat lines can be formed. Thus, when the fabric is kept folded and pleated up to the folding lines in the passing direction of the warp or the weft, in addition to the above-described conspicuous boundaries formed between the pleat portions and the non-pleat portions, the resulting pleated product has the pleat portions and the non-pleat portions arranged alternately.

A plurality of fabrics for a pleated product can be sewn together so that the passing directions of the warp and the weft are different, and folded along a folding line tilted at 45 degrees relative to the warp and the weft, followed by pleating. Then, on each plane on both sides of the portion folded along the folding line tilted at 45 degrees relative to the warp and the weft, the passing direction of the easy-to-pleat yarn corresponds to the direction of forming pleat lines in an area while the passing direction of the hard-to-pleat yarn corresponds to the direction of forming pleat lines in another area.

By pleating the above fabric, in the folded state, up to the folding line in the passing direction of the warp or the weft, both an area in which effective pleats are formed and an area in which effective pleats are not formed are produced on each plane on both sides of the folded portion with a boundary that is the sewn portion of the plurality of the fabrics for a pleated product. Accordingly, the resulting pleated fabric has the conspicuous boundaries between the pleat portions and the non-pleat portions not only at the folding line but also at the sewn portion.

Furthermore, the above plurality of fabrics for a pleated product that are sewn together so that the passing directions of the warp and the weft are different can be folded more than once along folding lines tilted at 45 degrees relative to the warp and the weft, and then pleated. In this case, effective pleat portions and ineffective pleat portions are alternately arranged on both sides of the sewn portion as a boundary and, in addition, on the portions folded more than once, pleats with a variety of directions of lines can be formed on one plane because the directions of forming effective pleats are different.

When the folding line is tilted at 45 degrees relative to the warp and the weft as described above, the ineffective pleats completely vanish after washing, but the angle is not necessarily to be 45 degrees. If the angle is not 45 degrees, the ineffective pleats do not vanish completely, leaving soft pleats. Even if the angle is not 45 degrees, since the fabric is pleated after folding, the direction of pleat lines on the pleat portions is different from the direction on the non-pleat portions, and the boundaries between these portions are very conspicuous. Furthermore, the boundaries between the firmly formed pleats on the effective pleat portions and the soft pleats on the ineffective pleat portions clearly stand out on the folding lines by the different levels of pleating forces.

Here, easy-to-pleat yarn means the yarn that easily form pleats and is usually employed for a pleated fabric, such as polyester. Hard-to-pleat yarn means the yarn that does not easily form pleats. As examples of the yarn that does not easily form pleats, rayon yarn and acrylic yarn can be used as well as natural fibers such as cotton yarn, hemp yarn or wool.

The present invention can exhibit the following effects:

(1) A part of a fabric for a pleated product in which one of the warp and the weft is formed of easy-to-pleat yarn and the other formed of hard-to-pleat yarn is folded along a folding line tilted relative to the warp and the weft, the fabric is pleated up to the folding line in the passing direction of the warp or the weft, and the fabric is unfolded and washed. This method can form pleats having conspicuous boundaries between pleat portions and non-pleat portions at the folding line, which has been regarded as impossible hitherto. Thus, pleat portions and non-pleat portions can be mixed on one sheet of material, thereby obtaining a nicely-varied pleated product with the boundaries between these portions standing out.

(2) A part of a fabric for a pleated product is folded more than once along a folding line tilted relative to the warp and the weft prior to pleating. By this method, pleat portions and non-pleat portions can be alternately arranged on one sheet of material with the boundaries between the pleat/non-pleat portions standing out.

(3) A plurality of fabrics for a pleated product can be sewn together so that the passing directions of the warp and the weft are different, and folded along a folding line tilted relative to the warp and the weft, followed by pleating. By this method, pleat portions and non-pleat portions can be mixed on one sheet of material, and the resulting pleated fabric is nicely-varied which has conspicuous boundaries between the pleat portions and the non-pleat portions not only at the folding line but also at the sewn portion.

(4) Furthermore, the above plurality of fabrics for a pleated product that are sewn together so that the passing directions of the warp and the weft are different can be folded more than once along a folding line tilted relative to the warp and the weft, and then pleated. By this method, pleats with a variety of directions of lines can be formed on one plane, and pleat portions and non-pleat portions can be mixed on one sheet of material. In addition, boundaries between the pleat portions and the non-pleat portions are conspicuous not only at the folding line tilted relative to the warp and the weft but also at the sewn portion, thereby obtaining resulting pleated product with nice variety.

(5) With an angle of a folding line tilted relative to the warp and the weft to be 45 degrees, lines of ineffective pleat portions are completely eliminated, and a nicely-varied pleated product having conspicuous boundaries between pleat portions and non-pleat portions distinguished by an existence of pleats can be obtained.

(6) When the angle of the above folding line is not 45 degrees relative to the warp and the weft, the lines of the ineffective pleat portions do not completely vanish while remaining soft pleats on non-pleat portions, and the resulting pleated product is a nicely-varied product with conspicuous boundaries between the pleat portions and the non-pleat portions defined by the direction of the pleats and the different levels of pleating forces.

BEST MODE FOR CARRYING OUT THE INVENTION

Embodiment 1

Figure 1:
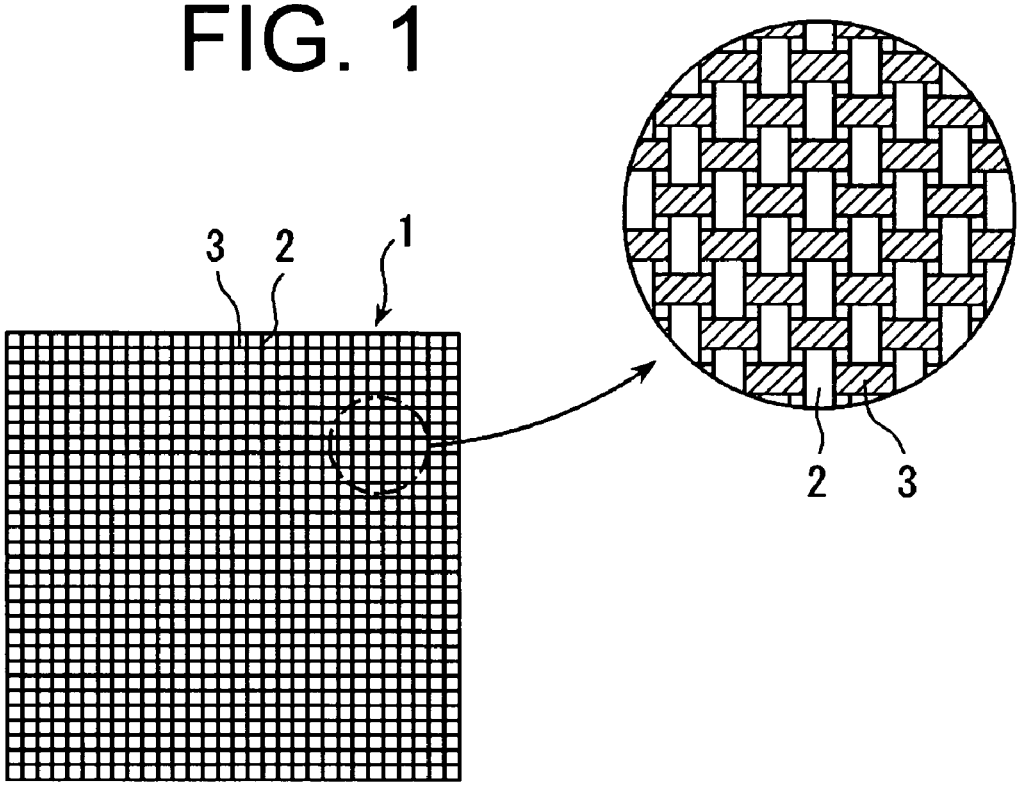
FIG. 1 is a plan view of a fabric for a pleated product according to an embodiment of the present invention.

FIG. 1 is a plan view of a fabric for a pleated product according to a first embodiment of the present invention.

A fabric for a pleated product 1 is a plain fabric in which warp 2 and weft 3 cross each other one-to-one. The warp 2 is rayon yarn such as cupra (cuprammonium rayon) or viscose rayon. Rayon yarn has a characteristic that it does not easily form pleats (hard-to-pleat). On the other hand, the weft 3 is polyester yarn which is often used for usual pleated products. Polyester yarn has a characteristic that it easily forms pleats (easy-to-pleat).

The above fabric for a pleated product 1 is partially pleated in accordance with the method described below. FIGS. 2 to 7 are explanatory views illustrating a pleating method of the fabric for a pleated product 1. Referring to FIG. 2 to 7, a pleat portion 5*a* is a portion on which pleats are formed in a final product, and a non-pleat portion 5*b* is a portion on which pleats are not formed resultantly.

Figure 2:
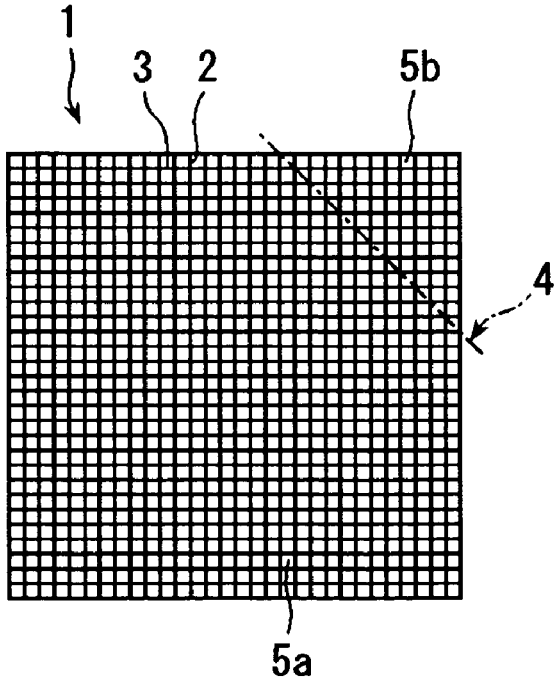
FIG. 2 is an explanatory view illustrating a pleating method of the fabric for a pleated product of FIG. 1.
Figure 3:
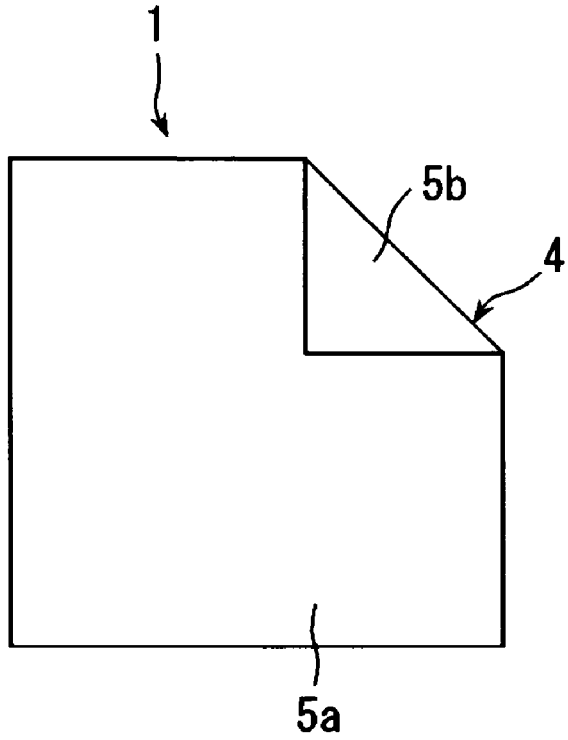
FIG. 3 is an explanatory view illustrating a pleating method of the fabric for a pleated product of FIG. 1.

Firstly, as shown in FIG. 2, the non-pleat portion 5*b* (an isosceles right triangle portion on the upper right side of FIG. 2) in the fabric for a pleated product 1 is folded onto a front side of the pleat portion 5*a* along a folding line 4 which is tilted at 45 degrees relative to the warp 2 and the weft 3. FIG. 3 shows a state after folding. In FIG. 3 and the subsequent drawings, the warp 2 and the weft 3 are not illustrated, but the warp 2 always passes in a vertical direction of the drawings and the weft 3 in a horizontal direction.

Figure 4A:
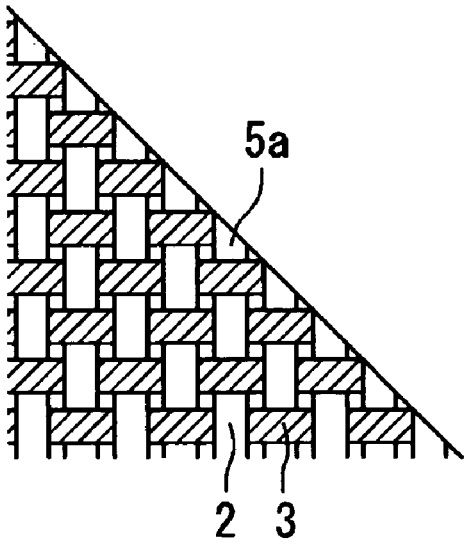
FIG. 4A is an enlarged view illustrating a crossing state of warp and weft on a pleat portion on the back side in FIG. 3.
Figure 4B:
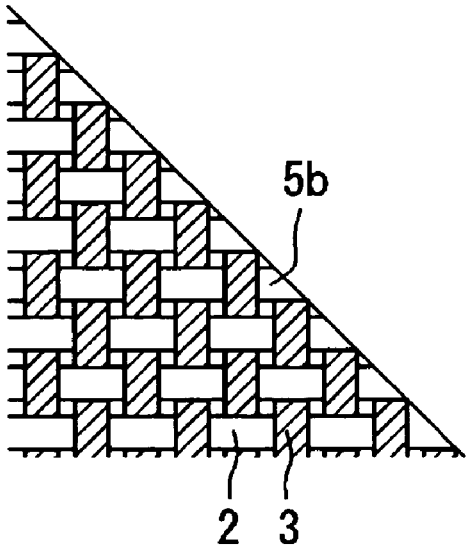
FIG. 4B is an enlarged view illustrating a crossing state of warp and weft on a non-pleat portion on the front side in FIG. 3.

FIGS. 4A and 4B are enlarged views of the folded portion of the fabric for a pleated product 1 in which FIG. 4A illustrates a crossing state of the warp 2 and the weft 3 on the pleat portion 5*a* on the back side of FIG. 3, and FIG. 4B illustrates a crossing state of the warp 2 and the weft 3 on the non-pleat portion 5*b* on the front side of FIG. 3. As shown in FIGS. 4A and 4B, in the portion folded along the folding line 4, a passing direction of the warp 2 (hard-to-pleat yarn) on a plane shown in FIG. 4A (the pleat portion 5*a*) corresponds to a passing direction of the weft 3 (easy-to-pleat yarn) on a plane shown in FIG. 4B (the non-pleat portion 5*b*), and a passing direction of the weft 3 (easy-to-pleat yarn) on the plane shown in FIG. 4A (the pleat portion 5*a*) corresponds to a passing direction of the warp 2 (hard-to-pleat yarn) on the plane shown in FIG. 4B (the non-pleat portion 5*b*).

Figure 5:
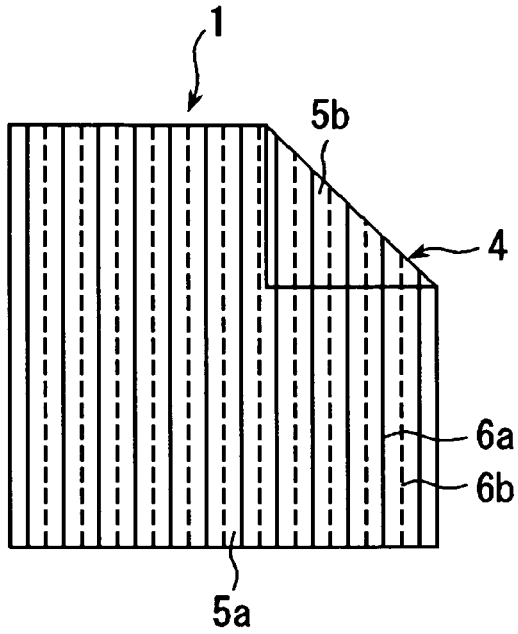
FIG. 5 is an explanatory view illustrating a pleating method of the fabric for a pleated product of FIG. 1.
Figure 6:
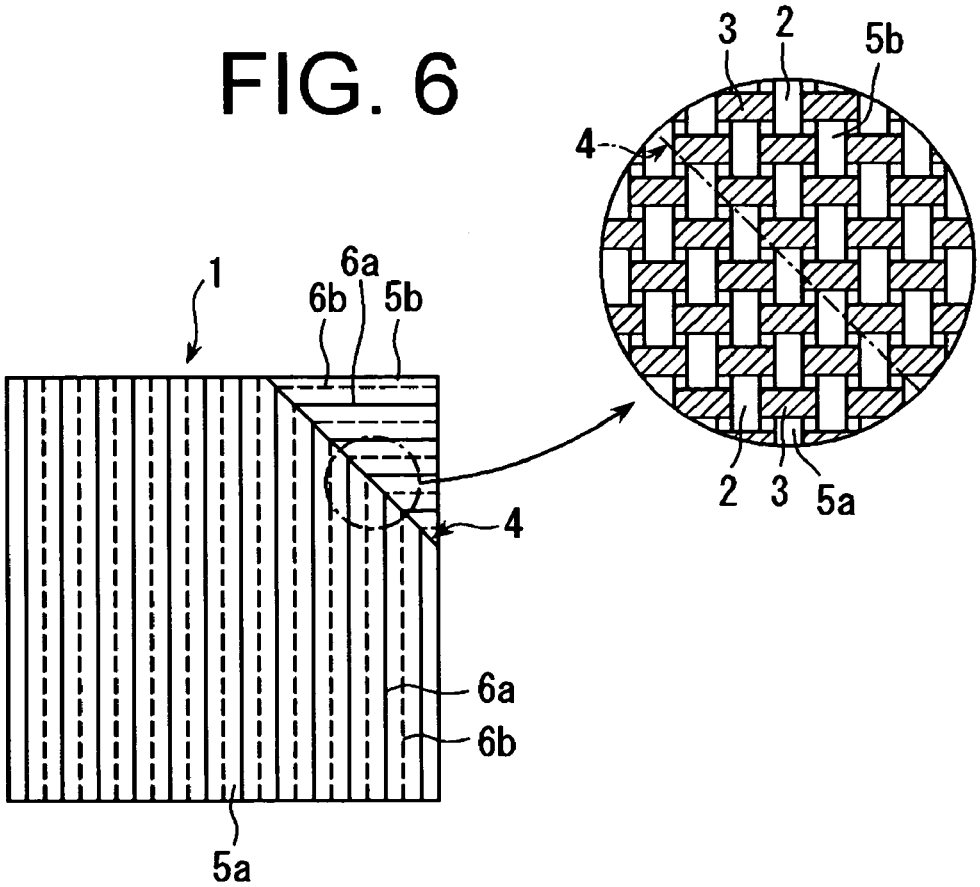
FIG. 6 is an explanatory view illustrating a pleating method of the fabric for a pleated product of FIG. 1.

Next, as shown in FIG. 5, while the fabric for a pleated product 1 is kept folded in this state, the fabric 1 is pleated all over the pleat portion 5*a* and the non-pleat portion 5*b* in the passing direction of the weft 3 in the pleat portion 5*a* up to the folding line 4. Vertical solid lines in FIG. 5 show peaks 6*a* of the pleat lines and vertical broken lines troughs 6*b* of the pleat lines, respectively. Then, the folded portion is unfolded as shown in FIG. 6 and washed. The washing may be done simply with water or using various kinds of detergents such as soap or synthetic detergent, or it may be dry-cleaning using volatile solvents.

When forming pleats, in the folded portion of the fabric for pleating product 1, the passing direction of the weft 3 (easy-to-pleat yarn) in the pleat portion 5*a* on the back side corresponds to a direction of forming the peaks 6*a* and the troughs 6*b* of the pleat lines (horizontal directions in FIGS. 5 and 6), and the passing direction of the warp 2 (hard-to-pleat yarn) in the non-pleat portion 5*b* on the front side corresponds to a direction of forming the peaks 6*a* and the troughs 6*b* of the pleat lines (a horizontal direction in FIG. 5 and a vertical direction in FIG. 6).

Figure 7:
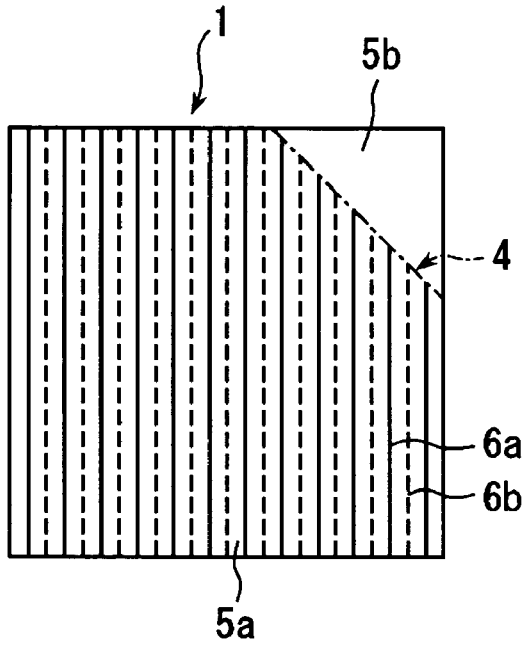
FIG. 7 is an explanatory view illustrating a pleating method of the fabric for a pleated product of FIG. 1.

Accordingly, effective pleats are formed only in the passing direction of the weft 3 (easy-to-pleat yarn) in the pleat portion 5*a* on the back side of the folded portion while no effective pleats are formed in the passing direction of the warp 2 (hard-to-pleat yarn) in the non-pleat portion 5*b* on the front side of the folded portion. Therefore, as shown in FIG. 7, the pleats in the passing direction of the warp 2 (hard-to-pleat yarn) in the non-pleat portion 5*b* vanish after washing. On the other hand, the pleats formed in the passing direction of the weft 3 (easy-to-pleat yarn) in the pleat portion 5*a* on the back side of the folded portion have the peaks 6*a* and the troughs 6*b* firmly formed up to the folding line 4.

As described above, a part of the fabric for a pleated product 1 in this embodiment is folded along the folding line 4 tilted at 45 degrees relative to the warp 2 and the weft 3, the fabric 1 is pleated in the passing direction of the weft 3 up to the folding line 4, and the fabric 1 is unfolded and washed. By this method, the pleats having conspicuous boundaries between the pleat portion 5*a* and the non-pleat portion 5*b* at the folding line 4 can be obtained. This pleating may be applied either prior to sewing or after sewing.

In the above embodiment, a plain fabric is exemplified as the fabric for a pleated product 1. However, any fabric that is made by crossing the warp 2 and the weft 3 in accordance with a regular rule, including a twilled fabric or a satin fabric, may be used.

In the above embodiment, the warp 2 is hard-to-pleat yarn and the weft 3 easy-to-pleat yarn. However, this can be structured reversely. In this case, by pleating the fabric for a pleated product 1 in a passing direction of the warp 2 in the pleat portion 5*a*, the non-pleat portion 5*b* can be formed similarly. The fabric 1 may also be folded toward the back side of the pleat portion 5*a* as well as toward the front side of the pleat portion 5*a* as described above.

Embodiment 2

Figure 8:
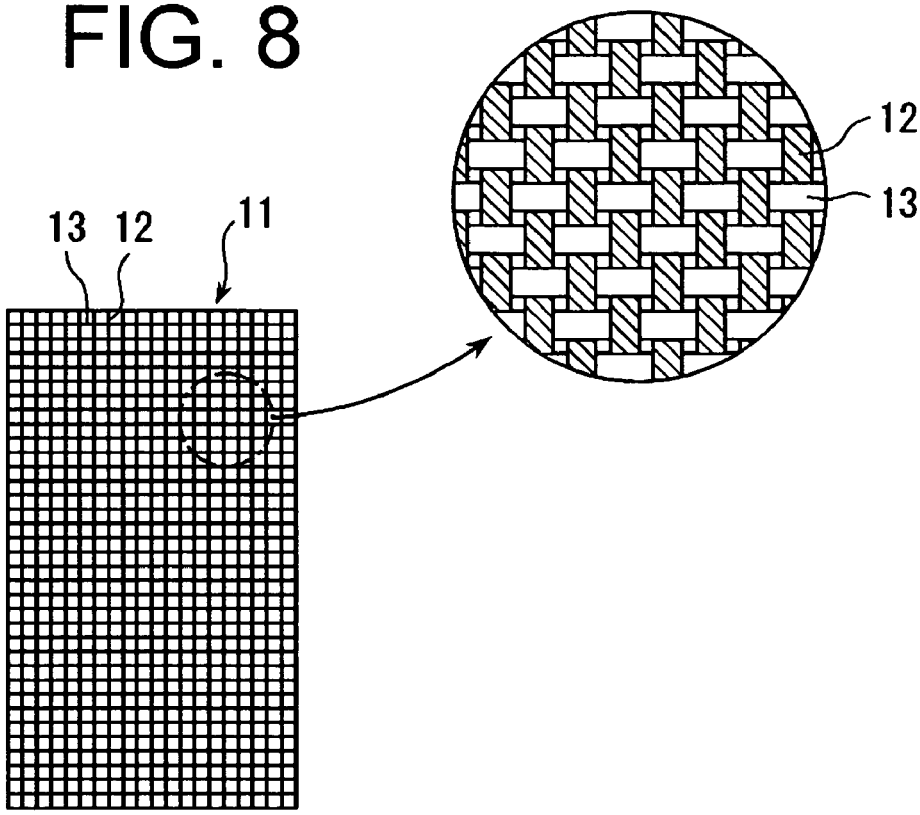
FIG. 8 is a plan view of a fabric for a pleated product according to a second embodiment of the present invention.

FIG. 8 is a plan view of a fabric for a pleated product according to a second embodiment of the present invention.

A fabric for a pleated product 11 in FIG. 8 is a plain fabric in which warp 12 and weft 13 cross each other one-to-one as in the fabric for a pleated product 1 in FIG. 1. The only difference from the fabric for a pleated product 1 in FIG. 1 is that the warp 12 is easy-to-pleat polyester yarn and the weft 13 is hard-to-pleat rayon yarn.

FIGS. 9 to 12 are explanatory views illustrating a pleating method according to this embodiment. Referring to FIG. 9 to 12, pleat portions 15*a* and 15*b* are portions on which pleats are formed in a final product, and a non-pleat portion 15*c* is a portion on which pleats are not formed resultantly.

Figure 9:
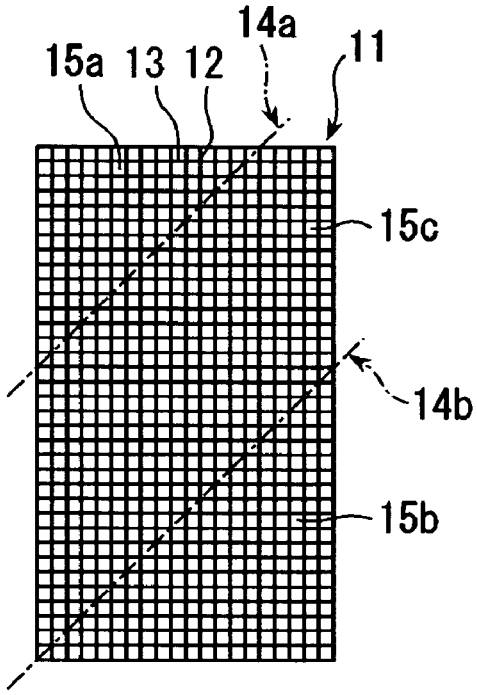
FIG. 9 is an explanatory view illustrating a pleating method of the fabric for a pleated product of FIG. 8.
Figure 10:
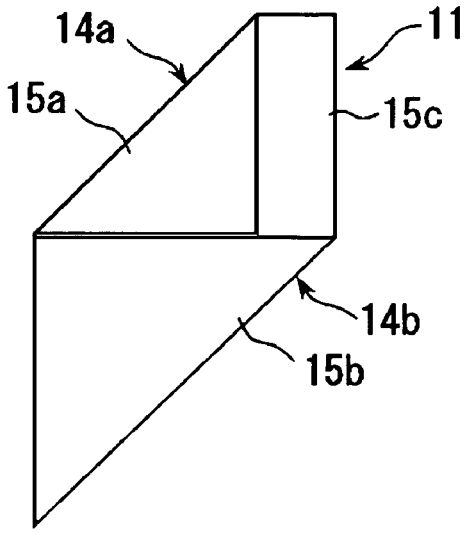
FIG. 10 is an explanatory view illustrating a pleating method of the fabric for a pleated product of FIG. 8.

As shown in FIG. 9, the pleat portions 15*a* and 15*b* of the fabric for a pleated product 11 are folded onto a front side of the non-pleat portion 15*c* along folding lines 14*a* and 14*b* tilted at 45 degrees relative to the warp 12 and the weft 13. FIG. 10 shows a state after folding. In FIG. 10 and the subsequent drawings, the warp 12 and the weft 13 are not illustrated, but the warp 12 always passes in a vertical direction of the drawings and the weft 13 in a horizontal direction.

Figure 11:
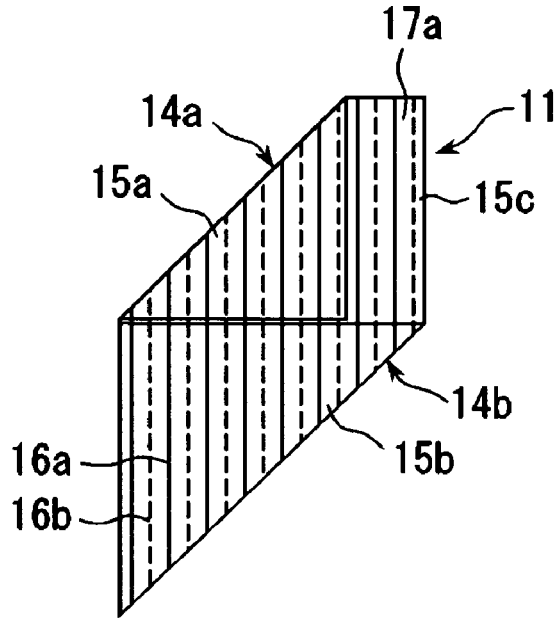
FIG. 11 is an explanatory view illustrating a pleating method of the fabric for a pleated product of FIG. 8.

Next, as shown in FIG. 11, while the fabric for a pleated product 11 is kept folded in this state, the fabric 11 is pleated all over the pleat portions 15*a* and 15*b* and the non-pleat portion 15*c* in the passing direction of the weft 13 in the non-pleat portion 15*c* up to the folding lines 14*a* and 14*b*. Vertical solid lines in FIG. 11 show peaks 16*a* of the pleat lines and vertical broken lines troughs 16*b* of the pleat lines, respectively.

Figure 12:
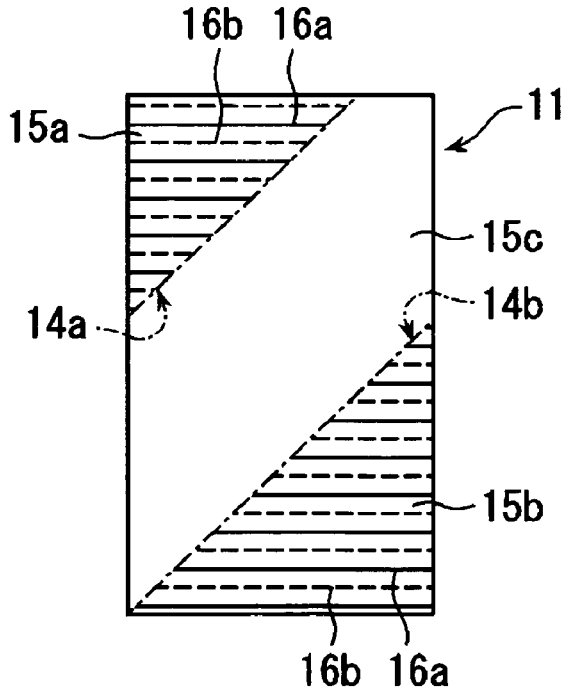
FIG. 12 is an explanatory view illustrating a pleating method of the fabric for a pleated product of FIG. 8.

Then, the folded portion is unfolded and washed. As shown in FIG. 12, the pleats formed in the passing direction of the warp 12 (easy-to-pleat yarn) in the pleat portions 15*a* and 15*b* have the peaks 16*a* and the troughs 16*b* firmly formed up to the folding lines 14*a* and 14*b* while the pleats in the passing direction of the weft 13 (hard-to-pleat yarn) on the non-pleat portion 15*c* vanish.

This is because, as the passing direction of the warp 12 (easy-to-pleat yarn) in the pleat portions 15*a* and 15*b* corresponds to a direction forming the peaks 16*a* and the troughs 16*b* of the pleat lines and the passing direction of the weft 13 (hard-to-pleat yarn) in the non-pleat portion 15*c* corresponds to the direction forming the peaks 16*a* and the troughs 16*b* of the pleat lines, effective pleats are formed only in the passing direction of the warp 12 (easy-to-pleat yarn) in the pleat portions 15*a* and 15*b* and no effective pleats are formed in the passing direction of the weft 13 (hard-to-pleat yarn) in the non-pleat portion 15*c*.

Figure 13:
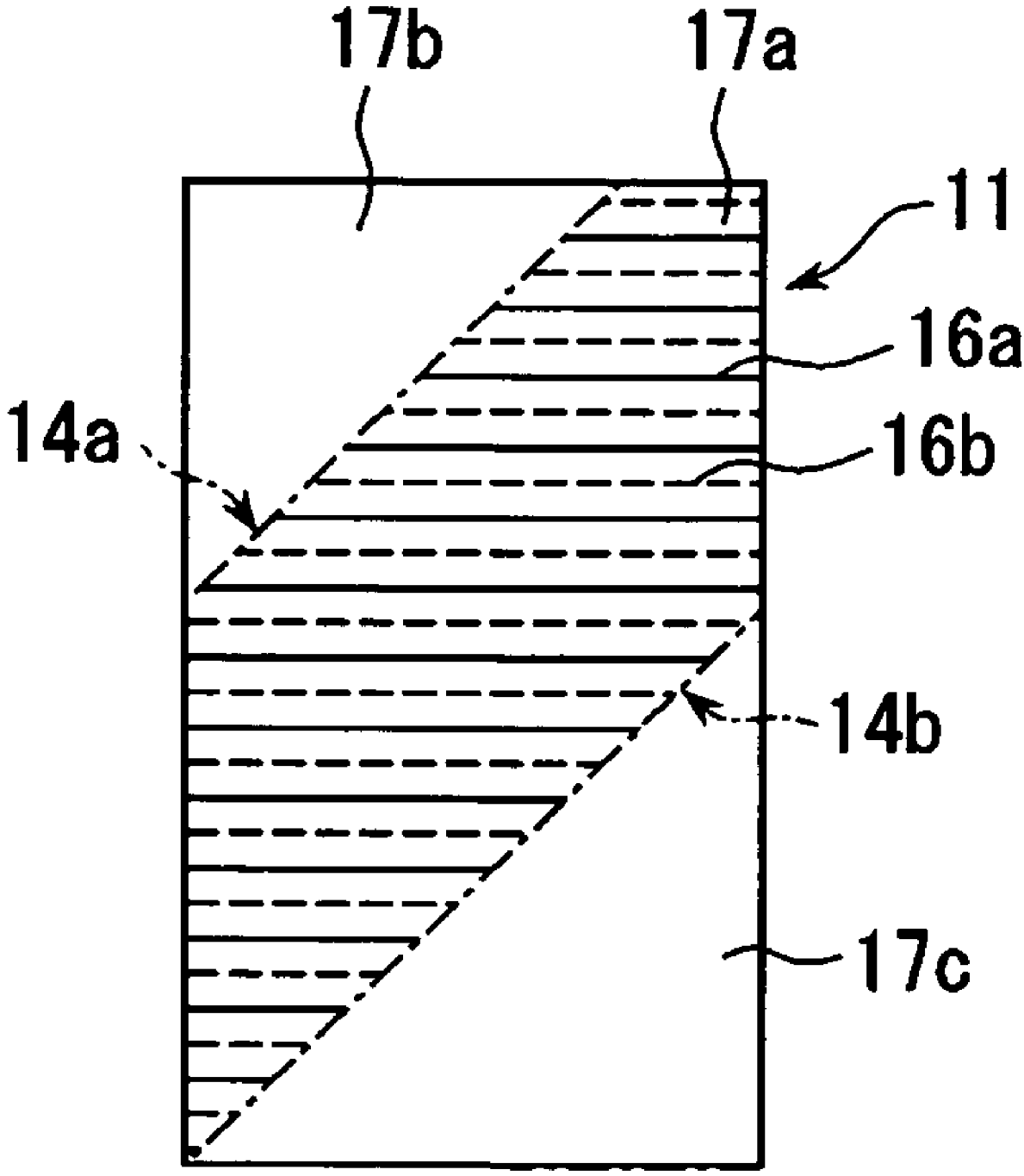
FIG. 13 is an explanatory view illustrating a pleating method of the fabric for a pleated product of FIG. 8.

In the state after folding shown in FIG. 10, if the fabric for a pleated product 11 is pleated all over the pleat portions 15*a* and 15*b* and the non-pleat portion 15*c* in the passing direction of the warp 12 in the non-pleat portion 15*c* (that is, the direction perpendicular to the pleating direction in FIG. 11) up to the folding lines 14*a* and 14*b*, the resulting pleated product is reversed with a pleat portion 17*a* and non-pleat portions 17*b* and 17*c* as shown in FIG. 13.

Embodiment 3

FIGS. 14A, 14B, 14C, 14D, 14E, 14F and 14G illustrate a manufacturing process of a pleated product according to a third embodiment of the present invention.

As in the fabric for a pleated product 1 in FIG. 1, a fabric for a pleated product 21 shown in FIGS. 14A to 14G is formed of warp (not shown) made of hard-to-pleat rayon yarn crossing in a horizontal direction in the drawings and weft made of easy-to-pleat polyester yarn crossing in a vertical direction in the drawings.

Figure 14A:
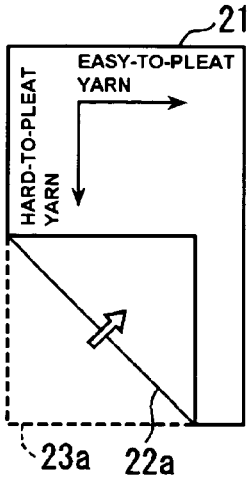
FIGS. 14A, 14B, 14C, 14D, 14E, 14F and 14G illustrate a manufacturing process of a pleated product according to a third embodiment of the present invention.
Figure 14B:
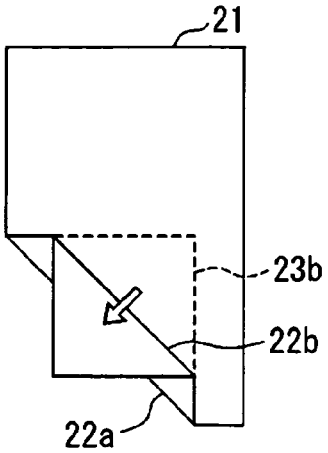
Figure 14C:
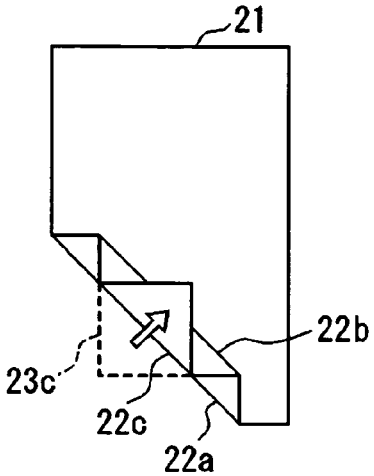
Figure 14D:
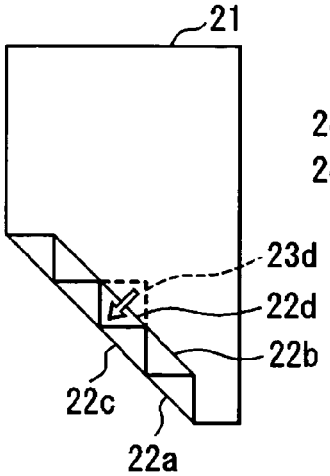

In this embodiment, firstly, as shown in FIG. 14A, a section 23*a* of the fabric for a pleated product 21 is folded toward an upper right corner on a front side of the drawing along a folding line 22*a* tilted at 45 degrees relative to the warp and the weft. Secondly, as shown in FIG. 14B, a section 23*b* of the fabric for a pleated product 21 is folded toward a lower left corner on a front side of the drawing along a folding line 22*b* tilted at 45 degrees relative to the warp and the weft. Furthermore, as shown in FIGS. 14C and 14D, sections 23*c* and 23*d* of the fabric of the pleated product 21 are folded toward the upper right corner and then the lower left corner on a front side of the drawing along folding lines 22*c* and 22*d* tilted at 45 degrees relative to the warp and the weft, respectively.

Figure 14E:
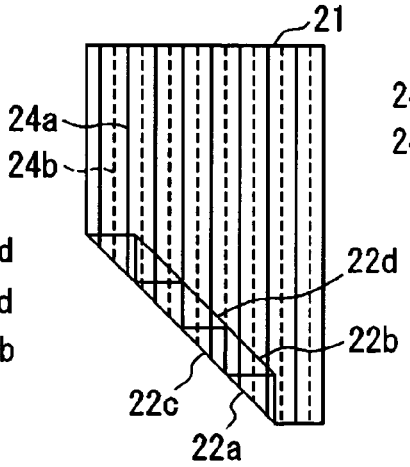
Figure 14F:
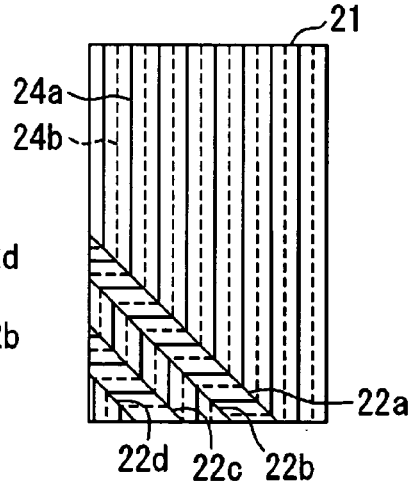

Then, as shown in FIG. 14E, in the state folded as above, the fabric for a pleated product 21 is pleated along a passing direction of the weft up to the folding lines 22*a*, 22*b*, 22*c* and 22*d*. Vertical solid lines in this drawing show peaks 24*a* of the pleat lines and vertical broken lines troughs 24*b* of the pleat lines, respectively. After pleating, all of the folded sections are unfolded as shown in FIG. 14F and washed.

Figure 14G:
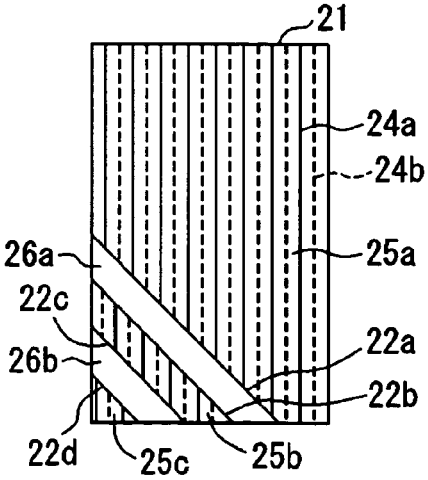

By this method, as shown in FIG. 14G, the resulting pleated product has pleat portions 25*a* , 25*b* and 25*c* and non-pleat portions 26*a* and 26*b* that are alternately arranged with conspicuous boundaries between the pleat/non-pleat portions at the folding lines 22*a*, 22*b*, 22*c* and 22*d*. This results from the existence of the portions in which a passing direction of easy-to-pleat yarn corresponds to a direction of forming the pleat lines (the pleat portions 25*a*, 25*b* and 25*c*) and the portions in which a passing direction of hard-to-pleat yarn corresponds to the direction of forming the pleat lines (the non-pleat portions 26*a* and 26*b*) in the repeatedly folded portions.

EXAMPLE 4

FIGS. 15A, 15B, 15C, 15D, 15E and 15F illustrate a manufacturing process of a pleated product according to a fourth embodiment of the present invention.

Figure 15A:
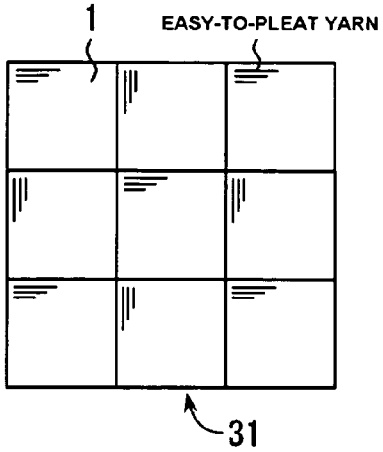
FIGS. 15A, 15B, 15C, 15D, 15E and 15F illustrate a manufacturing process of a pleated product according to a fourth embodiment of the present invention.

As shown in FIG. 15A, a fabric for a pleated product 31 of the present embodiment is made by arranging nine sheets of the fabric for a pleated product 1 in FIG. 1 in three by three so that passing directions of the warp and the weft in each sheet are different from passing directions of the warp and the weft in an adjacent sheet, respectively, and sewing the sheets together. In FIGS. 15A to 15F, only passing directions of easy-to-pleat yarn are illustrated, which are perpendicular to passing directions of hard-to-pleat yarn.

Figure 15B:
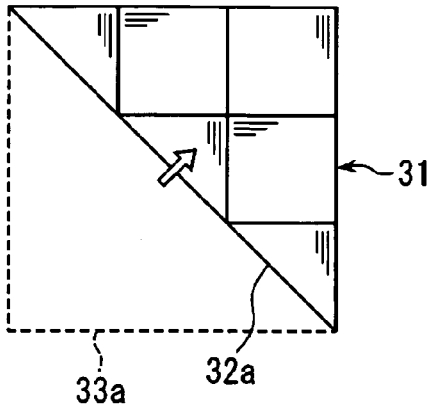
Figure 15C:
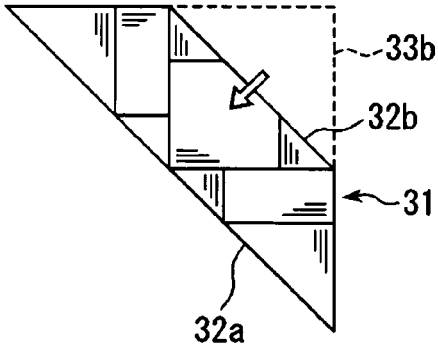

Firstly, as shown in FIG. 15B, a section 33*a* of the fabric for a pleated product 31 is folded toward an upper right corner on a front side of the drawing along a folding line 32*a* tilted at 45 degrees relative to the warp and the weft. Secondly, as shown in FIG. 15C, a section 33*b* of the fabric for a pleated product 31 is folded toward a lower left side on a front side of the drawing along a folding line 32*b* tilted at 45 degrees relative to the warp and the weft.

Figure 15D:
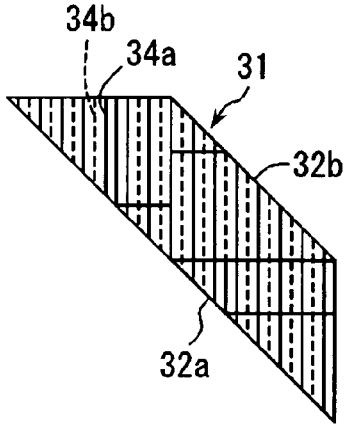
Figure 15E:
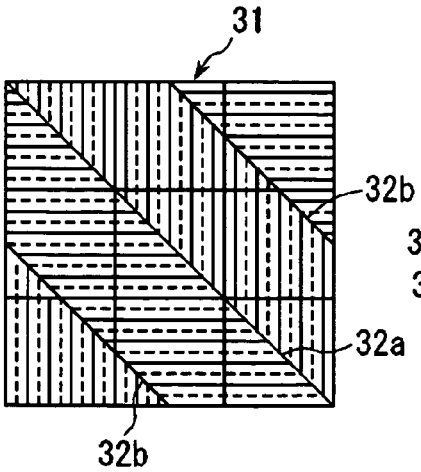

Next, as shown in FIG. 15D, in the above folded state, the fabric for a pleated product 31 is pleated in a horizontal direction of the drawing up to the folding lines 32*a* and 32*b*. Vertical solid lines in the drawing show peaks 34*a* of the pleat lines and vertical broken lines troughs 34*b* of the pleat lines, respectively. Then, all of the folded portions are unfolded as shown in FIG. 15E and washed.

Figure 15F:
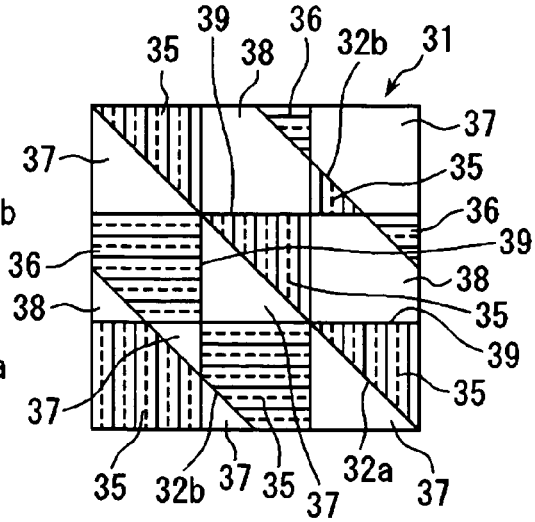

By this method, as shown in FIG. 15F, the resulting pleated product has pleat portions 35 and 36 and non-pleat portions 37 and 38 that are alternately arranged with the pleat lines formed in different directions on the pleat portions 35 and 36 in one plane. Furthermore, in this pleated product, boundaries between the pleat portions and the non-pleat portions are conspicuous not only at the folding lines 32*a* and 32*b* but also at a sewn portion 39. This is because the passing directions of the easy-to-pleat yarn and the hard-to-pleat yarn are different in one plane though the directions of forming the pleats are the same. It also results from the existence of the portions in which the passing direction of easy-to-pleat yarn corresponds to the direction of forming the pleat lines (the pleat portions 35 and 36) and the portions in which the passing direction of hard-to-pleat yarn corresponds to the direction of forming the pleat lines (the non-pleat portions 37 and 38) in the repeatedly folded portions

INDUSTRIAL APPLICABILITY

The present invention is useful for manufacture of pleated garments such as blouses, dresses or skirts.

The invention claimed is:

1. A method of manufacturing a pleated product, the method comprising:

providing a fabric comprising warp and weft, one of said warp and said weft being formed of polyester yarn constituting an easy-to-pleat yarn and the other of said warp and said weft being formed of a material constituting a hard-to-pleat yarn selected from a group consisting of rayon yarn, acrylic yarn, and natural fiber yarn which is composed entirely of natural fibers;

folding said fabric along a first folding line, said first folding line being angled relative to said warp and said weft;

pleating said fabric up to said folding line in a passing direction of one of said warp and said weft; and unfolding and washing said fabric.

2. The method of claim 1, wherein said fabric includes a first fabric piece comprising a first warp and a first weft, one of said warp and said weft being formed of polyester yarn constituting an easy-to-pleat yarn and the other of said warp and said weft being formed of a material constituting a hard-to-pleat yarn selected from a group consisting of rayon yarn, acrylic yarn, and natural fiber yarn which is composed entirely of natural fibers, and a second fabric piece comprising a second warp and a second weft, one of said second warp and said second weft being formed of polyester yarn constituting an easy-to-pleat yarn and the other of said second warp and said second weft being formed of a material constituting a hard-to-pleat yarn selected from a group consisting of rayon yarn, acrylic yarn, and natural fiber yarn which is composed entirely of natural fibers; and said first folding line is angled relative to each of said first warp, said second warp, said first weft, and said second weft.

3. The method of claim 1, further comprising:

folding said fabric along a second folding line, said second folding line being angled relative to said warp and said weft;

wherein said pleating occurs after folding said fabric along said first folding line and folding said fabric along a second folding line.

4. The method of claim 2, further comprising:

folding said fabric along a second folding line, said second folding line being angled relative to each of said first warp, said second warp, said first weft, and said second weft;

wherein said pleating occurs after folding said fabric along said first folding line and folding said fabric along a second folding line.

5. The method of claim 1, wherein the first folding line is angled relative to said warp and said weft at an angle of 45 degrees.

6. The method of claim 2, wherein said first folding line is angled relative to each of said first warp, said second warp, said first weft, and said second weft at an angle of 45 degrees.

7. The method of claim 3, wherein each of said first folding line and said second folding line is angled relative to said warp and said weft at an angle of 45 degrees.

8. The method of claim 4, wherein each of said first folding line and said second folding line is angled relative to each of said first warp, said second warp, said first weft, and said second weft at an angle of 45 degrees.

9. The method of claim 1, further comprising:

folding said fabric along a second folding line, said second folding line being angled relative to said warp and said weft;

folding said fabric along a third folding line, said third folding line being angled relative to said warp and said weft;

wherein said pleating occurs after folding said fabric along said first folding line, folding said fabric along a second folding line, and folding said fabric along said third folding line.

10. The method of claim 2, further comprising:

folding said fabric along a second folding line, said second folding line being angled relative to each of said first warp, said second warp, said first weft, and said second weft;

folding said fabric along a third folding line, said third folding line being angled relative to each of said first warp, said second warp, said first weft, and said second weft;

wherein said pleating occurs after folding said fabric along said first folding line, folding said fabric along a second folding line, and folding said fabric along said third folding line.

11. The method of claim 1, wherein said natural fiber yarn is composed entirely of a material selected from a group consisting of cotton, hemp, or wool.

12. A method of manufacturing a pleated product, the method comprising:

providing a fabric comprising warp and weft, one of said warp and said weft being formed of polyester yarn and the other of said warp and said weft being formed of a material selected from a group consisting of rayon yarn, acrylic yarn, and natural fiber yarn which is composed entirely of natural fibers;

folding said fabric along a first folding line such that a first portion of said fabric is on a first side of first folding line and a second portion of said fabric is on a second side of said first folding line, said first folding line being angled relative to said warp and said weft; and pleating said fabric up to said folding line in a passing direction of one of said warp and said weft such that one of said first portion and said second portion is pleated and the other of said first portion and said second portion is not pleated.

13. The method of claim 12, wherein said fabric includes a first fabric piece comprising a first warp and a first weft, one of said warp and said weft being formed of polyester yarn and the other of said warp and said weft being formed of a material selected from a group consisting of rayon yarn, acrylic yarn, and natural fiber yarn which is composed entirely of natural fibers, and a second fabric piece comprising a second warp and a second weft, one of said second warp and said second weft being formed of polyester yarn and the other of said second warp and said second weft being formed of a material selected from a group consisting of rayon yarn, acrylic yarn, and natural fiber yarn which is composed entirely of natural fibers; and said first folding line is angled relative to each of said first warp, said second warp, said first weft, and said second weft.

14. The method of claim 12, further comprising:

folding said fabric along a second folding line, said second folding line being angled relative to said warp and said weft;

wherein said pleating occurs after folding said fabric along said first folding line and folding said fabric along a second folding line.

15. The method of claim 13, further comprising:

folding said fabric along a second folding line, said second folding line being angled relative to each of said first warp, said second warp, said first weft, and said second weft;

wherein said pleating occurs after folding said fabric along said first folding line and folding said fabric along a second folding line.

16. The method of claim 12, wherein said natural fiber yarn is composed entirely of a material selected from a group consisting of cotton, hemp, or wool.

* * * * *